US012004614B1

(12) United States Patent
Shintani

(10) Patent No.: US 12,004,614 B1
(45) Date of Patent: Jun. 11, 2024

(54) POLE GRIPS

(71) Applicant: Amanda Leah Shintani, North Vancouver (CA)

(72) Inventor: Amanda Leah Shintani, North Vancouver (CA)

(73) Assignee: Amanda Leah Shintani, North Vancouver (CA)

( * ) Notice: Subject to any disclaimer, the term of this patent is extended or adjusted under 35 U.S.C. 154(b) by 186 days.

(21) Appl. No.: 17/452,470

(22) Filed: Oct. 27, 2021

Related U.S. Application Data

(60) Provisional application No. 63/107,855, filed on Oct. 30, 2020.

(51) Int. Cl.
*A45B 9/02* (2006.01)
*A45B 3/02* (2006.01)
*A45B 9/00* (2006.01)

(52) U.S. Cl.
CPC ..... *A45B 9/02* (2013.01); *A45B 3/02* (2013.01); *A45B 2009/002* (2013.01)

(58) Field of Classification Search
CPC ..... A45B 9/02; A45B 3/02; A63C 11/222
See application file for complete search history.

(56) References Cited

U.S. PATENT DOCUMENTS

| | | | | |
|---|---|---|---|---|
| 3,085,814 | A | 4/1963 | Scott | |
| 3,479,045 | A | 11/1969 | Miller | |
| 4,172,601 | A | 10/1979 | Hutter | |
| 4,730,632 | A | 3/1988 | Mace | |
| 4,953,862 | A | 9/1990 | Uke | |
| 5,287,870 | A | 2/1994 | Rhodes | |
| 5,470,108 | A | 11/1995 | Goode | |
| 6,998,576 | B2 * | 2/2006 | Marquis | B25G 1/00 219/541 |
| 7,758,455 | B2 | 7/2010 | Thomas | |
| 8,123,252 | B2 | 2/2012 | Lenhart | |
| 8,276,943 | B2 | 10/2012 | Best et al. | |
| D775,926 | S | 1/2017 | Atkins | |
| 9,591,902 | B1 * | 3/2017 | Hyde | G01B 21/16 |
| 10,064,463 | B2 | 9/2018 | Kreis et al. | |
| 10,083,882 | B2 | 9/2018 | Balakrishnan et al. | |
| 11,071,361 | B2 * | 7/2021 | AlGhazi | A45B 3/00 |
| 2007/0251559 | A1 * | 11/2007 | Yu | A45B 3/02 135/66 |

(Continued)

FOREIGN PATENT DOCUMENTS

| | | | |
|---|---|---|---|
| DE | 29900206 | U1 | 1/2000 |
| DE | 202014000659 | U1 | 3/2014 |

(Continued)

OTHER PUBLICATIONS

FitMi: The High-Tech Home Exercise Program. Sep. 9, 2020. 14 pages.

(Continued)

*Primary Examiner* — Noah Chandler Hawk
(74) *Attorney, Agent, or Firm* — Shin Hung; VanTek IP LLP

(57) ABSTRACT

A grip configured for interconnection to a therapy or walking pole is provided. The grip includes tactile, visual, and/or auditory feedback systems that help ensure a user is using the walking poles correctly. The feedback information may also be directed to a therapist for review.

20 Claims, 5 Drawing Sheets

(56) References Cited

U.S. PATENT DOCUMENTS

| | | | | |
|---|---|---|---|---|
| 2010/0254751 | A1 | 7/2010 | McMillan, III | |
| 2017/0224573 | A1* | 8/2017 | Challa | A45B 9/04 |
| 2019/0216186 | A1* | 7/2019 | Shintani | A63C 11/221 |
| 2021/0316203 | A1* | 10/2021 | Dubois | A63C 11/222 |

FOREIGN PATENT DOCUMENTS

| | | | |
|---|---|---|---|
| EP | 2168641 | A1 | 3/2010 |
| FR | 2497675 | A2 | 7/1982 |

OTHER PUBLICATIONS

MusicGlove Hand Therapy for Stroke, TBI, and SCI Recovery. Sep. 9, 2020. 10 pages.

* cited by examiner

POLE GRIPS

This application claims the benefit of U.S. Provisional Patent Application Ser. No. 63/107,855, filed Oct. 30, 2020, the entire disclosure of which is incorporated by reference herein.

This application is also related to U.S. patent application Ser. No. 16/083,882, filed Mar. 7, 2017, now U.S. Pat. No. 10,863,804, which is incorporated by reference herein.

FIELD OF THE INVENTION

Embodiments of the present invention are generally related to ergonomic grips that provide tactile, visual, and auditory cues to aid patients and their therapists in addressing acute or chronic neuro-muscular issues. The grips may be interconnected to stabilization devices such as therapy or walking poles.

BACKGROUND OF THE INVENTION

Those of ordinary skill in the art will appreciate that individuals with impaired motor functionality, such as those who have experienced a stroke, a brain injury, spinal cord injury, or suffer from Parkinson's disease, often find it difficult to use the upper and lower extremities of their body's "affected side" and thus, do not walk with a normal walking pattern where opposite arm and leg swing together. Canes and walkers are often used to help impaired individuals walk but present many challenges for treating these chronic conditions. Canes provide sensory, auditory, and visual cueing and awareness to the patient's "normal side" but often hinder awareness and movement of the patient's affected side. Further, canes do not promote the arm swing of a normal walking pattern and do not provide bilateral support which forces the user to lean to one side, a less than optimal posture. Existing walker designs also do not promote an upright posture as they cause the user to hunch over both grips. Further, walkers prevent a normal walking pattern where arm and leg swing alternate to engage legs and upper extremity muscles.

Nordic walking poles exercise both the upper and lower body muscles, in contrast to regular walking that only exercises the lower body. Nordic walking poles also provide bilateral support to improve balance and an upright posture. Nordic walking poles held in each hand have been used for rehabilitation purposes, basic mobility, and fitness, and it has been discovered that walking poles increase exercise persistence and intensity. Many studies demonstrate the benefits of Nordic walking poles, especially for less active, older adults.

The proper use of many Nordic walking poles entails the application of a downward force onto straps associated with the pole's grips, which causes excessive strain on the user's wrist joint. In addition, pole straps have been identified as a likely cause for the most common injury related to Nordic walking—strain or tearing of the ulnar collateral ligament of the thumb after a fall. Nordic walking poles can also provide a challenge as users with grasping issues find the commonly employed twist/turn pole lock system difficult to secure. The maximum weight-bearing capacity using a twist/turn pole lock system is about 90 pounds. In comparison, a flip-lock system may support 120 pounds.

Patient reliance on walking aids often increases recovery time and establishes bad habits. Accordingly, an additional cueing mechanism is desirable to ensure individuals use walking poles correctly to promote a normal walking pattern. Indeed, it is a long-felt need to provide a walking assist system that encourages users to walk correctly, promoting recovery. The following disclosure describes an improved grip interconnected to therapy or walking poles that provide tactile, visual, and/or auditory feedback to help the user regain a normal walking gait or comply with predefined exercise regimens.

SUMMARY OF THE INVENTION

It is one aspect of embodiments of the present invention to provide a grip that produces sensory feedback, e.g., visual, tactile, and auditory feedback, to promote awareness of an affected arm and or leg and, thus, promote proper swaying and weight-bearing on the affected leg to normalize a walking pattern. The contemplated grip can be used in seated and standing exercises to promote the affected arm and/or leg movement. In some embodiments, the grip is large, which reduces flexion tone often associated with stroke patients. Of course, the grip may incorporate a wide range of grip sizes for users of a variety of ages, regardless of gender. The grip may also include a flared segment associated with its dorsal region that fits the user's palm, as described in U.S. patent application Ser. No. 16/083,882. In some embodiments, the grip has a cavity extending upwardly designed to reduce vibration. The ergonomic grip of one embodiment is made of thermoplastic rubber to provide a balance of strength and flexibility in the central grip region and an optional wrist support. One embodiment of the present invention employs a pole having a button lock system that can support up to 200 pounds, which is necessary if the grip is used instead of a cane or walker.

Grips must be used correctly to ensure proper arm and wrist alignment, arm and shoulder movement, and a normal gait pattern of contralateral movement of opposite arms and legs. A physical therapist often defines this criterion to ensure the user will recover quickly or to address bad habits that could cause future health issues. One of ordinary skill in the art will appreciate that in some embodiments, visual, auditory, and tactile cues are used, but in other embodiments, only one or a subset of these methods are employed. Visual cues may consist of flashing light, and an auditory device may include a speaker. Further, the grip may have a textured surface to increase sensory cueing to increase awareness of the affected hand. In one embodiment, incorrect grip positioning of the user's hand can be easily identified. For example, a bumper or a portion with a uniquely knurled surface is provided so that the user will quickly appreciate that they are grasping the grip incorrectly.

Vibration may also be used as a tactile means to promote awareness of the affected hand. For example, one embodiment of the present invention provides a vibrating device located in the grip's central or lower portion. The grip of one embodiment vibrates when the grip is outside the desired orientation or predefined area, when arm swing is insufficient, or when too little or too much force is applied to the grip. To achieve this aspect of some embodiments of the present invention, the grip may include a plurality of accelerometers, strain gauges, or other force/acceleration measuring devices that define the orientation of the grip in 3-space. The vibrating mechanism may be battery-powered and rechargeable. Of course, grip vibration need not be automatic but may be triggered externally by a therapist using known wireless communication methods, such as Bluetooth®, Wi-Fi, and/or NFC devices.

The contemplated grips and related systems described herein provide a tool for therapist-directed and independent rehabilitation. More specifically, the grips of some embodiments of the invention are interconnected to short poles for therapist use. The contemplated therapy poles are about 1.5-4.5 feet in length and may be height adjustable. The "therapy poles" may selectively interconnect to the grip, wherein the patient can easily switch to walking poles if needed after a therapy session. The therapy poles are designed to allow the therapist standing near, often behind the patient, to guide the grips' location patient grasps them. This functionality enables the therapist to teach the patient proper arm movement, arm control, etc. The incorporation of feedback means, as described herein, will allow the therapist and patient to identify when the grips are being used correctly or incorrectly. For example, pressure sensors embedded in the grips will communicate to the auditory, visual, and/or tactile feedback device if the grip is squeezed too tightly. Those of ordinary skill in the art will appreciate that grip position above the therapist's floor, for example, can also be monitored, which will help assess arm swing.

In one embodiment, the contemplated grip is interconnected to a walking pole, and the patient uses a pair of poles/grips. The grips may be customized for left or right-handed use and symmetrically shaped to fit respective left and right hands. The walking poles can be reinforced, adjustable-length mobility poles provided with button locks that maintain pole length. In other embodiments, the walking poles are height adjustable by other known methods or are fixed length. The grips allow increased user stability and provide an optimal ergonomic grip for a greater range of users. The grips described herein are ideally used with walking poles designed to support the greatest downwards force possible with a segmented pole locking mechanism that is easy and safe to use.

As mentioned above, the grip of one embodiment has an extended portion that supports the hand's ulnar heel portion and wrist in a neutral position. The wrist support of one embodiment extends substantially perpendicular to a longitudinal axis of the grip. In one embodiment of the ergonomic grip, the wrist support substantially surrounds the grip region's lower portion. In another embodiment, the wrist support is approximately 161 mm long from its front end to its rear end. Providing a wrist support allows for an even distribution of force across the hand and wrist, thus increasing comfort, weight-bearing capacity, and stability. Distributing load in this matter reduces contact stress and allows force to concentrate at the ulnar heel, the joint's center of rotation. This aspect is of particular advantage where the user's walking ability is compromised and more force needs to be exerted from the user's hands through the grips/poles to the ground. The wrist support provided on some grips is an ergonomic feature and provides a significant difference in terms of even force distribution across the hand for all sizes and activities.

The tactile, auditory, and visual cueing mechanisms described herein may indicate one or more of proper arm swing, incorrect or correct pole positioning (especially as the pole tips strike the ground), the degree of force application through the pole, etc. In some embodiments, visual cues are transmitted to another location, such as smart glasses worn by the user or a light-emitting device interconnected to the user's glasses, hat, or wristband. Further, the grip may include at least one speaker that emits a specific auditory cue, e.g., a buzz, if the grip and/or pole is being used incorrectly—pole position is incorrect, force application is incorrect, etc. Proper arm swing may also be indicated in this fashion, wherein when the user's hand achieves a predetermined height on the upstroke and/or downstroke, an auditory signal is issued. Such a signal would encourage the user to maintain the proper gait pattern to address the incorrect gait pattern. And in some embodiments, the auditory cues are sent to the user's smartphone, a secondary sound-emitting device maintained by the user, the user's hearing aids or earbuds, etc.

Again, pole positioning, arm swing, and/or proper pressure application may be important, and such criteria are defined by healthcare professionals, such as physical therapists. Thus, instead of predetermined presets programmed into the grip, some embodiments of the present invention allow healthcare professionals to program patient-specific use criteria. In operation, a physical therapist preprograms the grip and/or poles to fit a specific therapy protocol and duration of use. Thereafter, the user is given the grips/poles allowed to continue their therapy unaided by the physical therapist. In some embodiments, however, the therapist will be able to communicate directly with the pole and change presets in real-time if the need arises. For example, a user may contact the physical therapist indicating that the pole's use was uncomfortable, wherein the physical therapist can actively provide instructions on how to alter pole configuration or alter the pole via known wireless communication methods. The grip may allow the user's activities to be stored and downloaded for professional analysis. Further, the pole may also be adapted to communicate with cellular, Bluetooth®, near field communication (NFC) protocols, Wi-Fi, or other wireless communications to communicate directly with the healthcare professional during use. Of course, the pole can also be configured to communicate with the user's smart device. In this fashion, the user and/or physical therapist can monitor grip/pole use and, if necessary, overlay use parameters with an indoor two-dimensional or three-dimensional boundary or an outdoor geographic location that may include elevation data. Such locational data can be obtained by the grip/pole via GPS technology or the user's smartphone, which could help the physical therapists ensure the grip/poles are being used correctly. In one embodiment, the grips/poles are used with an immersive three-dimensional virtual reality headset, such as an Oculus headset.

It is a related aspect of some embodiments of the present invention to provide emergency functionality, wherein the grips and/or poles include GPS tracking technology and location information. Accordingly, the user can use the poles to provide accurate location data to emergency responders if an emergency occurs. Such signal may be in the form of an emergency locator transmission (ELT) initiated when the poles experience an impact above a certain threshold. In other embodiments, tapping the poles in a certain sequence may be used to initiate the ELT. In some embodiments, a series of accelerometers are provided and are configured to sense a rapid orientation change indicating the user has stumbled or fallen. At which time, emergency responders would correspond directly with the user via the speaker on the grip, walking pole, or a wireless call to the user's mobile device. This GPS functionality may also be used to ensure that the user maintains travel along a predetermined path.

It is another aspect of some embodiments of the present invention to provide grips and walking poles that increase bilateral movement during seated and standing exercises, increase shoulder and scapula range of movement, improve posture by ensuring that the individual does not hunch while walking. In addition, the contemplated system also reduces flexion contraction of the upper extremities, increases support in the hand and wrists, and maintains them in a correct functional position. Importantly, embodiments of the present invention improve motivation and enjoyment for exercise and gait training.

Thus, it is one aspect of one embodiment of the present invention to provide an ergonomic grip, comprising: an upper portion having a light-emitting device, a sound-emitting device, and a vibration motor; a central portion having a plurality of gripping regions; a lower portion; a wrist support extending from the lower portion and having a first potentiometer associated with the sound emitting device and a second potentiometer associated with the vibration motor; and wherein the wrist support defines a lower surface of the grip having an opening for selective receipt of a pole and an on/off switch.

It is still yet another aspect of embodiments of the present invention to provide an ergonomic grip, comprising: an upper portion having a light-emitting device, a sound-emitting device, and a vibration motor; a central portion having a plurality of gripping regions; and a lower portion.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
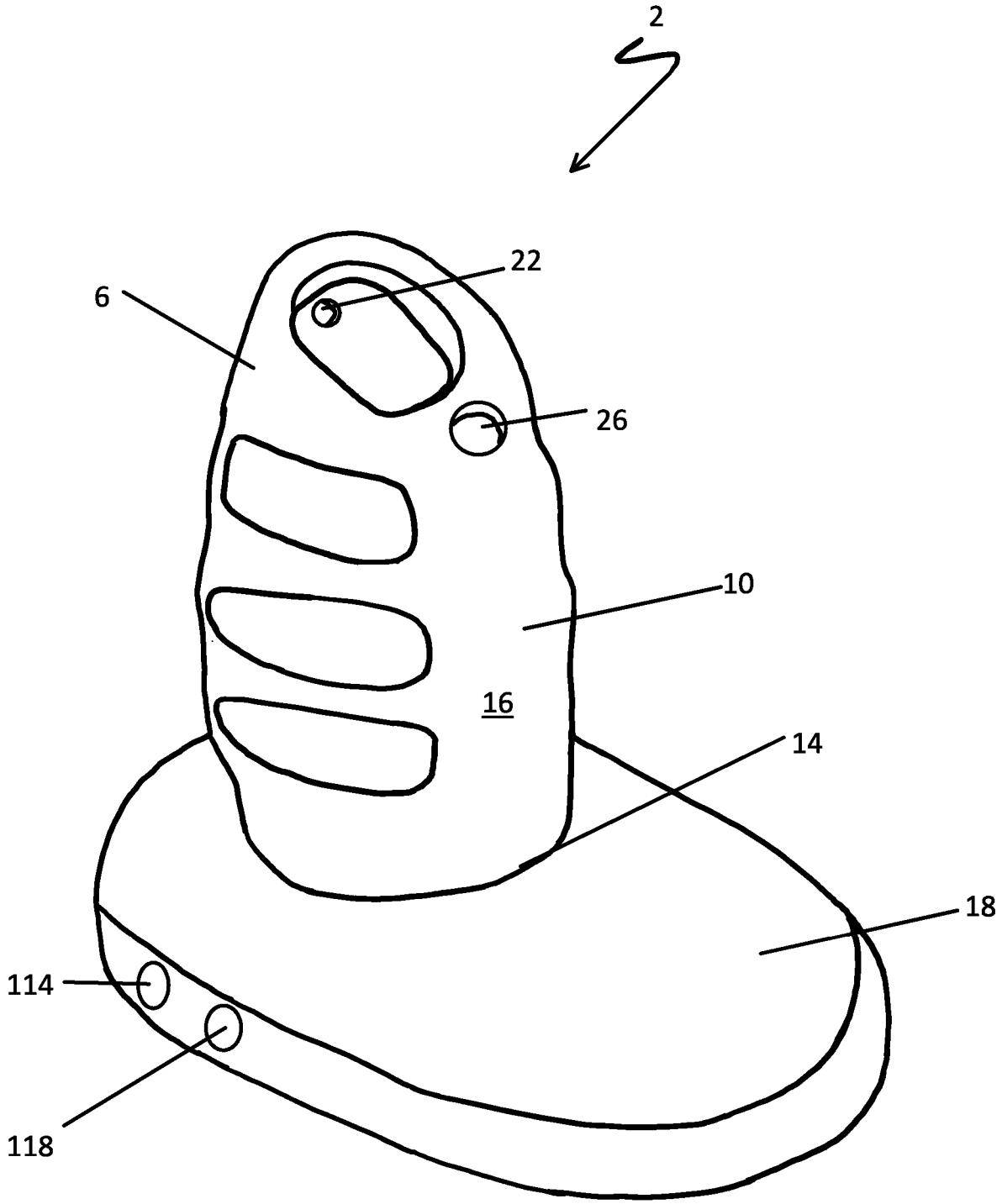
FIG. 1 is a right perspective view of a grip of one embodiment of the present invention.
Figure 2:
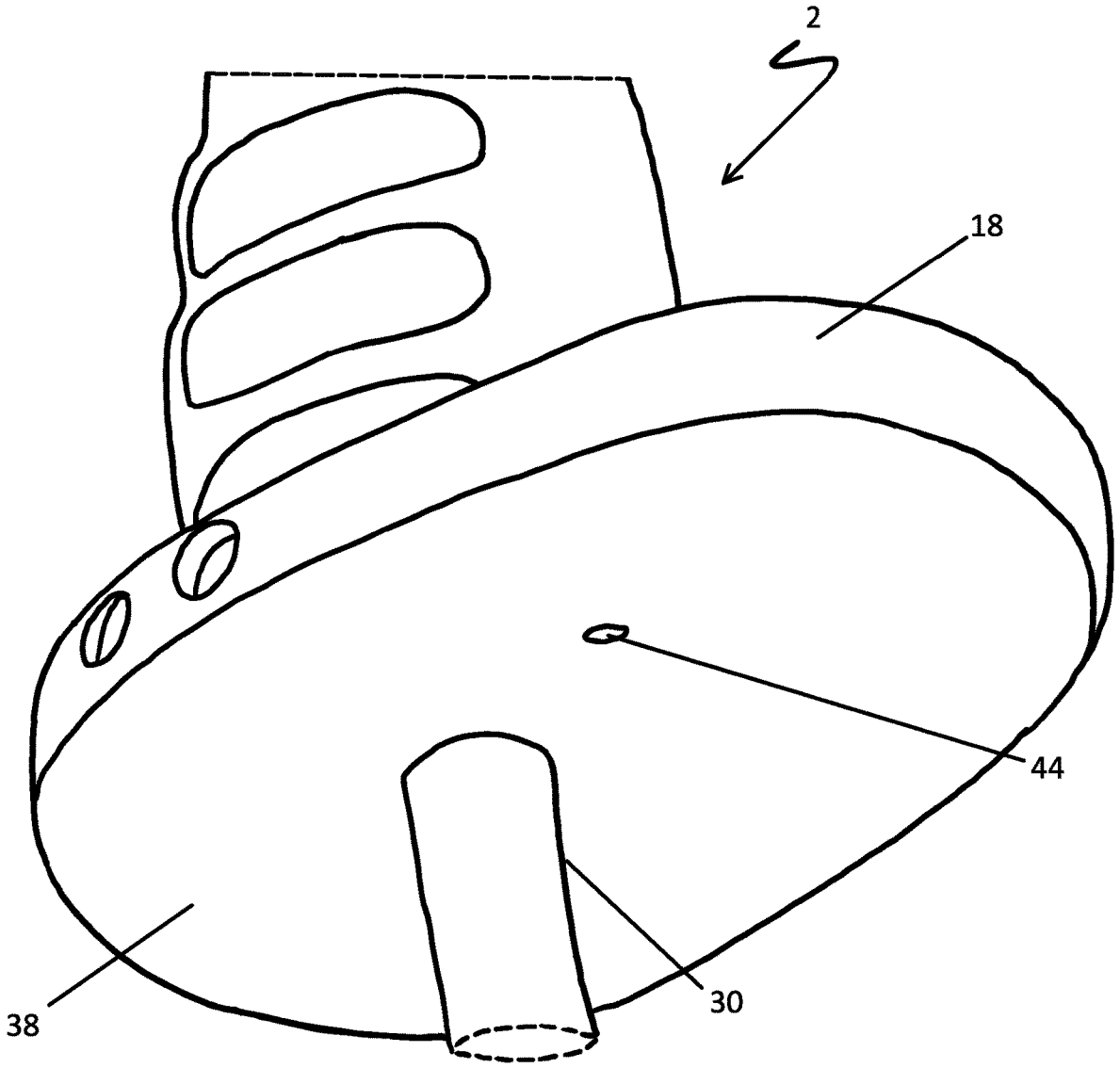
FIG. 2 is a bottom perspective view of the grip shown in FIG. 1.

The following component list and associated numbering found in the drawings is provided to assist in the understanding of one embodiment of the present invention:

Component
2 Grip
6 Central portion
14 Lower portion
16 Dorsal region
18 Wrist support
22 Light
26 Speaker
30 Pole
34 Opening
38 Bottom surface
44 On/off switch
50 Upper cavity
54 Lower cavity
60 Charge port
102 Battery
106 Microcontroller
110 Transistor
114 Buzzer potentiometer
118 Vibration potentiometer
122 Vibration motor It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-6 show a grip 2 of one embodiment of the present invention generally consisting of an upper portion 6, a central portion 10, and a lower portion 14. Some embodiments also include a wrist support 18 interconnected to the lower portion 14. The rear surfaces of the upper portion 6, central portion 10, and lower portion 14 defined the grip's dorsal region 16. In this example, the upper portion 6 accommodates a light 22 and a speaker 26, but those of ordinary skill in the art will appreciate that such components can be located on other portions of the grip 2. For example, the middle portion may include visual, auditory, and/or tactile feedback devices that communicate sensory feedback to the user/therapist. A pole 30 is inserted through an opening 34 in a bottom surface 38 and, thus, secured to the grip 2. The pole 30 may also communicate sensory feedback to the user/therapist. An on/off button 44 is also provided on the bottom surface 38, but can be located at another location. The embodiment of FIGS. 1-6 is used primarily in a therapy setting, wherein short therapy poles are used instead of full-length walking poles. In a related embodiment, a secondary stick the therapist uses to manipulate the patient's arm forward is attached to the therapy pole and/or grip. In one embodiment, a walking pole is selectively interconnected to the grip such that that it can be quickly removed and replaced with a therapy pole and/or stick.

As described above, the light, which may be an LED device, may be capable of various modes. For example, an on/off mode may be provided, wherein the light remains on. In addition, the light may blink at a preset frequency when predetermined situations are encountered. The light may emit light of different colors depending on the mode of operation, on/off, wireless signal interconnectivity, grip orientation outside predetermined norms, etc. The speaker, which may emit a buzzing noise, can also function in this manner, wherein a sound is emitted when the grip is turned on or off, is outside a predetermined orientation, when pressure applied thereto exceeds the predetermined amount, or when pressure applied thereto is below a predetermined amount. The sound and visual feedback can be sent to a cellular phone, through a radio signal, hearing aids, or computer system. The vibration motor can likewise operate under these conditions to notify the user and/or therapist of the current mode of operation and grip orientation. Of course, a plurality of lights may be employed.

Figure 3:
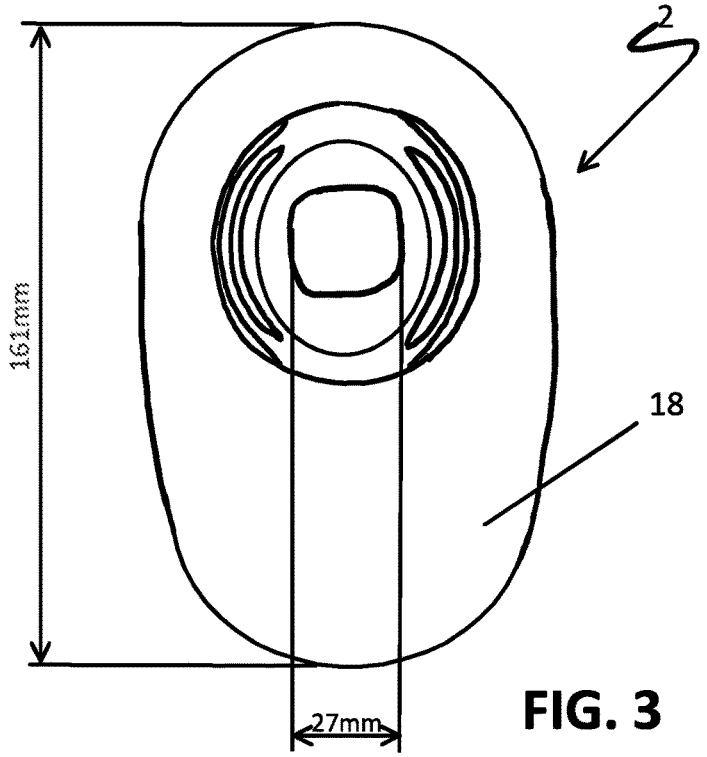
FIG. 3 is a top plan view of the grip shown in FIG. 1
Figure 4:
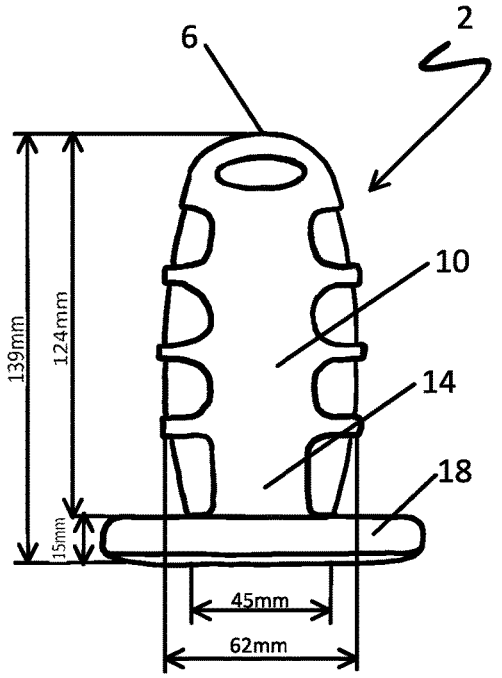
FIG. 4 is a right elevation view of the grip shown in FIG. 3.
Figure 5:
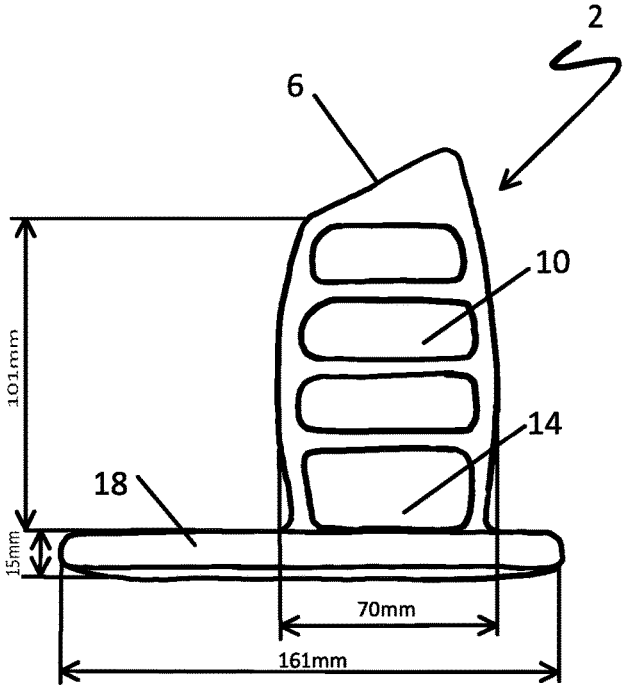
FIG. 5 is a rear elevation view of the grip shown in FIG. 3.

FIGS. 3-5 show the grip of one embodiment of the present invention. One of ordinary skill in the art will appreciate the dimensions shown are for reference only and the embodiments of the present invention described herein may be increased or reduced in size.

Figure 6:
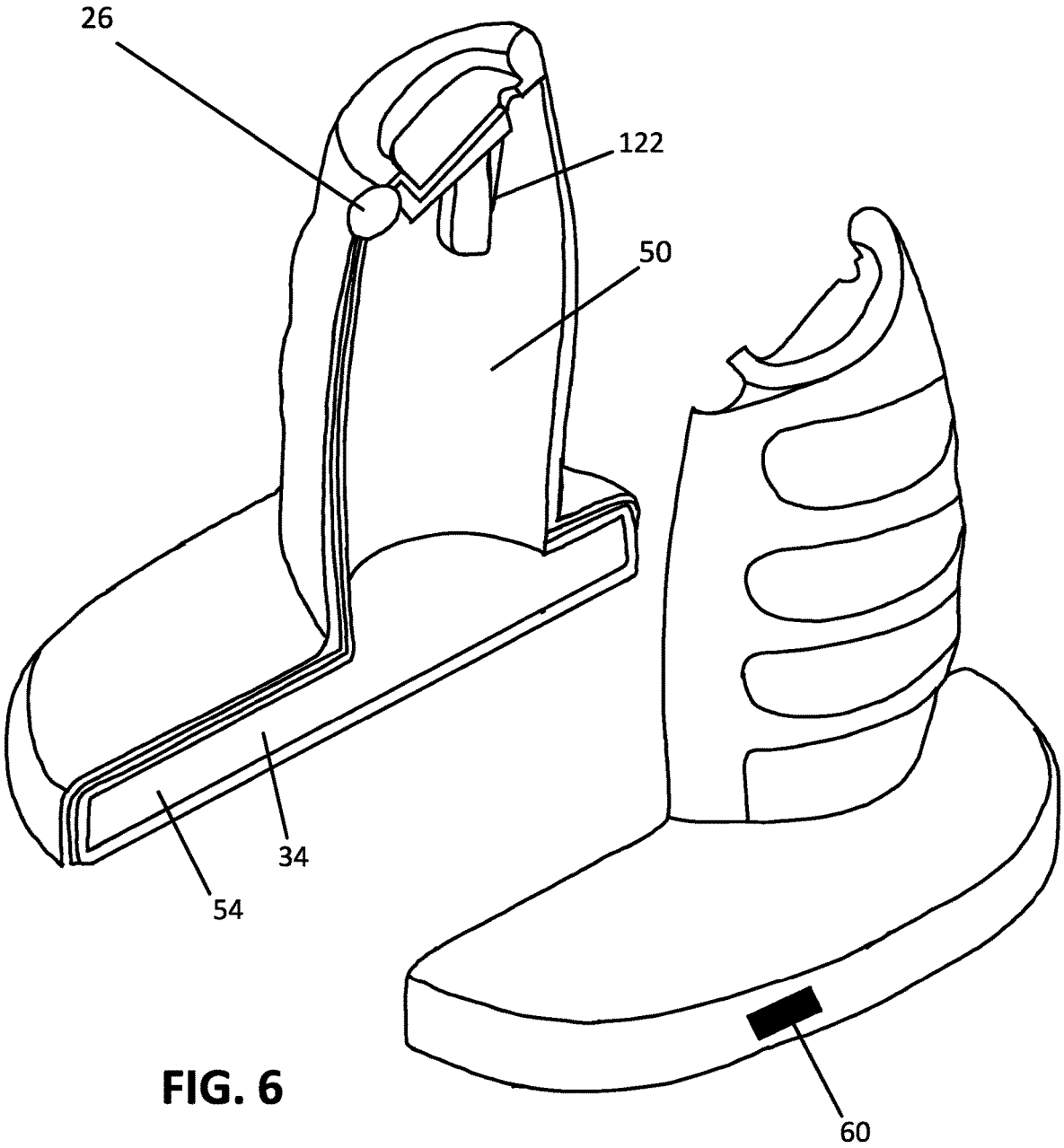
FIG. 6 is an exploded view of the grip shown in FIG. 1, wherein internal electronic componentry is removed for clarity.

FIG. 6 is an exploded view of the grip of one embodiment of the present invention showing an upper cavity 50 and a lower cavity 54 configured to receive a battery and electronic componentry associated with the light, speaker, on and off switch, etc. described above. As one of ordinary skill in the art will appreciate, the cavity or cavities may be supported by structural members, e.g., webs, or the grip may be only partially hollow. FIG. 6 also shows a charge port 60. The charge port may be a USB charge port or any other charge port currently used. In some embodiments, charging is achieved wirelessly using, for example, inductive charging techniques.

Figure 7:
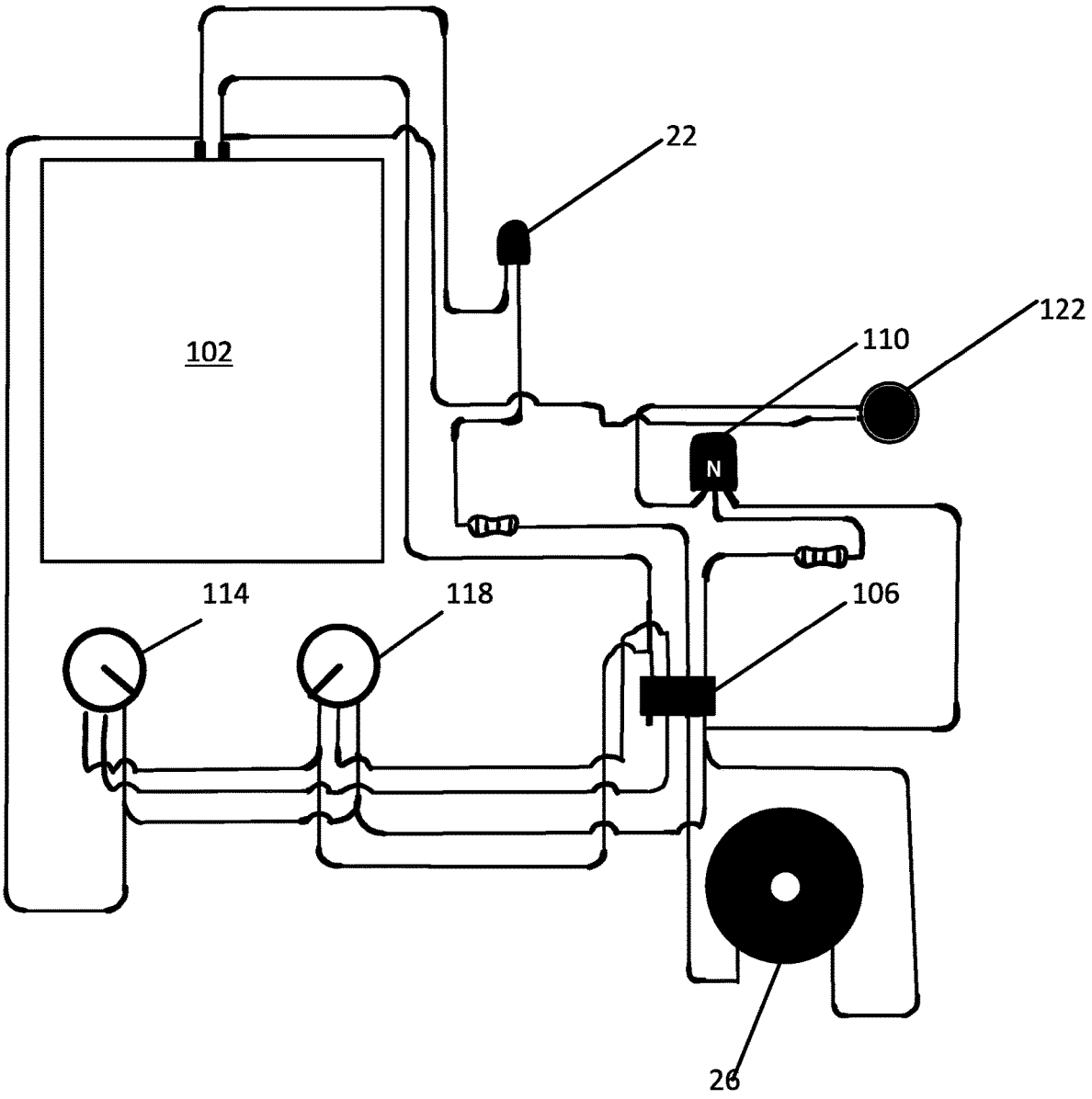
FIG. 7 is a circuit diagram illustrating the electrical components employed by one embodiment of the present invention.

FIG. 7 shows a circuit diagram associated with the electronic components employed by one embodiment of the present invention. A battery 102 powers a microcontroller 106 that communicates with a transistor 110, a buzzer potentiometer 114, and a vibration potentiometer 118. The transistor 110, buzzer potentiometer 114, and vibration potentiometer 118 control the functionality of a vibration motor 122, the light 22, and the speaker 26, which is also referred to herein as a "buzzer."

In operation, the contemplated grip 2 is maintained in the user's hand with their wrist position adjacent to or on the wrist support 18. As mentioned above, the grip may include various accelerometers or other devices to indicate angular and spatial orientation. Pressure sensors may also be employed within the upper, middle, and/or lower portions to assess applied pressure. If angular/spatial orientation, pressure, or other factors are outside predetermined bounds, the light, which may be an LED light, will activate by blinking or changing colors. In addition, the speaker will emit a buzzing sound, for example, if the grip is held too tightly, is out of a predetermined orientation, or has impacted a surface.

As mentioned above, the extended walking pole may include features that assess pole angle and applied load. For example, the pole may include a plurality of strain gauges, accelerometers, or other sensors that allow contact angle, pole orientation, and applied load to be assessed. This information can be fed to the grip and/or pole for access later or transmitted in real-time to the user's smart device or to the therapist via known wireless communication techniques. This information helps the therapist and user assess whether the user is applying equal or substantially equal forces to each pole while they are walking on an even surface, for example. Indications of proper pole use and weight distribution may also be directed to the speakers, lights, and/or a vibration device, wherein the user is notified if after a predetermined number of strides, their arm swing, pole positioning, impact characteristics, and/or impact load is outside predetermined criteria.

The grip/polls may also include other devices such as pedometers or may be able to selectively receive weights (to address tone, for example). or other devices to facilitate a physical therapy regime. Some embodiments of the present invention also include pulse and/or oxygen sensors implanted into the central grip, for example.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims.

Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A pair of ergonomic grips, comprising:

a first grip configured for gripping by a persons left hand; and a second configured for gripping by a person right hand, the first grip and the second grip including an upper portion having a light-emitting device, a sound-emitting device, and a vibration motor, a central portion having a plurality of gripping regions;

a lower portion, a wrist support extending from the lower portion and having a first potentiometer associated with the sound emitting device and a second potentiometer associated with the vibration motor, wherein the wrist support defines a lower surface of the grip having an opening for selective receipt of a pole and an on/off switch, measuring devices configured to determine when the first grip and the second grip reach predetermined upstroke and downstroke heights during alternate arm swinging by the person while gripping the first grip and the second grip, and a pressure sensor configured to determine an applied force against an even surface when a pole is received in the opening, wherein the determined applied force in the first grip and the second grip are compared to each other for determining weight distribution during the alternate arm swinging.

2. The ergonomic grips of claim 1, wherein the first grip and the second grip further include means for wireless communication.

3. The ergonomic grips of claim 1, wherein for each of the first grip and the second grip the vibration motor, light-emitting device, and sound-emitting device are interconnected to a controller embedded within the upper, central, or lower portion.

4. The ergonomic grips of claim 3, wherein the controller is pre-programmable or can be programmed.

5. The ergonomic grips of claim 1, wherein for each of the first grip and the second grip the wrist support extends substantially perpendicular to a longitudinal axis of the grip.

6. The ergonomic grips of claim 1, wherein for each of the first grip and the second grip the wrist support substantially surrounds a majority of the lower portion.

7. The ergonomic grips of claim 1, wherein for each of the first grip and the second grip the wrist support is configured to support a rear area of the user's hand adjacent to the user's wrist.

8. The ergonomic grips of claim 1, wherein for each of the first grip and the second grip the wrist support is approximately 161 mm in length from a front end edge to a rear edge thereof.

9. The ergonomic grips of claim 1, wherein for each of the first grip and the second grip a dorsal region of at least one of the upper portion, central portion, and lower portion is flared.

10. The ergonomic grips of claim 1, wherein each of the first grip and the second grip medial and lateral sides of the central portion is textured.

11. The ergonomic grips of claim 1, further including therapy poles inserted through the opening provided on the lower surface of the wrist support for each of the first grip and the second grip.

12. The ergonomic grips of claim 1, wherein the the first grip and the second grip is made of thermoplastic rubber.

13. The ergonomic grips of claim 1, wherein the each of the first grip and the second grip is mounted on the top of a respective mobility device.

14. The ergonomic grips of claim 13, wherein the mobility device is a reinforced adjustable-length walking pole with button lock securement of pole length segments.

15. A pair of ergonomic grips, comprising:

a first grip configured for gripping by a persons left hand; and a second grip configured for gripping by the persons right hand, the first grip and the second each including an upper portion having a light-emitting, device, a sound-emitting device, and a vibration motor, a central portion having a plurality of gripping regions, a lower portion, measuring devices configured to determine when the first grip and the second grip reach predetermined upstroke and downstroke heights during alternate arm swinging by the person while gripping the first grip and the second grip, and a pressure sensor configured to determine an applied force against an even surface when a pole is received in the opening, wherein the determined applied force in the first grip and the second grip are compared to each other for determining weight distribution during the alternate arm swinging.

16. The ergonomic grips of claim 15, wherein for each of the first trip and the second grip a dorsal region of at least one of the upper portion, central portion, and lower portion is flared.

17. The ergonomic grips of claim 15, wherein each of the first grip and the second grip is mounted on the top of respective mobility device.

18. The ergonomic grips of claim 15, wherein each of the first grip and the second grip further comprises a wrist support extending from the lower portion.

19. The ergonomic grips of claim 18, wherein for each of the first grip and the second grip the vibration motor, light-emitting device, and sound-emitting device are interconnected to a controller embedded within the upper portion, central portion, lower portion, or wrist support.

20. The ergonomic grips of claim 18, wherein for each of the first grip and the second grip wrist support defines a lower surface of the grip that has an opening for selective receipt of a pole and an on/off switch further including a therapy pole inserted through the opening provided on the lower surface of the wrist support.

* * * * *